US009988816B2

(12) United States Patent
Zhang

(10) Patent No.: US 9,988,816 B2
(45) Date of Patent: Jun. 5, 2018

(54) FASTENING ARRANGEMENTS FOR A METAL ROOF

(71) Applicant: Xiuming Zhang, Winnipeg (CA)

(72) Inventor: Xiuming Zhang, Winnipeg (CA)

( * ) Notice: Subject to any disclaimer, the term of this patent is extended or adjusted under 35 U.S.C. 154(b) by 0 days. days.

(21) Appl. No.: 15/168,180

(22) Filed: May 30, 2016

(65) Prior Publication Data

US 2018/0023300 A1 Jan. 25, 2018

Related U.S. Application Data

(60) Provisional application No. 62/180,414, filed on Jun. 16, 2015, provisional application No. 62/190,329, filed on Jul. 9, 2015.

(51) Int. Cl.
*E04D 1/34* (2006.01)
*E04D 1/18* (2006.01)
*E04D 1/26* (2006.01)

(52) U.S. Cl.
CPC ..... *E04D 1/34* (2013.01); *E04D 1/18* (2013.01); *E04D 1/265* (2013.01); *E04D 2001/3423* (2013.01); *E04D 2001/3426* (2013.01); *E04D 2001/3467* (2013.01)

(58) Field of Classification Search
CPC .. E04D 1/34; E04D 1/18; E04D 1/265; E04D 2001/3423; F16B 5/0275
USPC ..... 411/389, 401
See application file for complete search history.

(56) References Cited

U.S. PATENT DOCUMENTS 1,579,715 A * 4/1926 Boyle ..... E04D 1/34 403/408.1
1,978,190 A * 10/1934 Figge ..... E04D 1/34 52/543
1,987,133 A * 1/1935 Smith ..... E04D 1/34 411/458
3,295,873 A * 1/1967 Attwood ..... F16B 7/18 403/206
4,366,910 A * 1/1983 Uccello ..... A47B 57/485 211/191
5,509,767 A * 4/1996 Easton ..... B65G 21/06 411/400
5,533,313 A * 7/1996 Pike ..... E04D 1/34 52/521

(Continued)

*Primary Examiner* — Paola Agudelo
(74) *Attorney, Agent, or Firm* — Kyle R Satterthwaite; Ryan W Dupuis; Ade & Company Inc.

(57) ABSTRACT

Metal roofing includes metal roof-covering sheets or tiles having apertures along longitudinal end edges for coupling a pair of the sheets in an overlapping condition. One fastening arrangement comprises a fastener having a shaft extending in a longitudinal direction and fastening features at longitudinally spaced positions along the shaft. The fastening features may comprise a fastening peg or an opening receiving a fastening member therethrough. The pegs and openings may be combined in such a manner that at least two of the features cooperate with the apertures of the respective sheet in opposing transverse directions so as to longitudinally offset the apertures in the overlapping condition. Another fastening arrangement comprises a roof-covering sheet locating fastenings pegs which are spaced inward of the apertures in a longitudinal direction of the sheet so as to form the longitudinal offset between the respective sets of apertures.

6 Claims, 5 Drawing Sheets

(56) References Cited

U.S. PATENT DOCUMENTS

| | | | | |
|---|---|---|---|---|
| 5,921,045 | A * | 7/1999 | Hickey | E04D 1/045 52/543 |
| 6,247,289 | B1 * | 6/2001 | Karpinia | E04D 1/26 52/543 |
| 8,087,206 | B1 * | 1/2012 | Worley | E04D 1/30 52/520 |
| 8,584,406 | B2 * | 11/2013 | Wexler | F24J 2/5237 108/150 |
| 9,322,174 | B1 * | 4/2016 | Williams | E04D 1/34 |
| 2004/0120786 | A1 * | 6/2004 | Suehiro | F16B 5/02 411/82 |

* cited by examiner

FASTENING ARRANGEMENTS FOR A METAL ROOF

CROSS REFERENCE TO RELATED APPLICATIONS

This application claims benefit under 35 U.S.C. 119(e) of Provisional Application Ser. No. 62/180,414, filed Jun. 16, 2015 and Provisional Application Ser. No. 62/190,329 filed Jul. 9, 2015, the entireties of which are incorporated herein by reference.

FIELD OF THE INVENTION

The present invention relates generally to roofing, and more particularly to metal roofing using metal sheets or tiles for covering a roof.

BACKGROUND

Metal roofs are gaining popularity for use on commercial and residential buildings. Metal roofs have several advantages over traditional asphalt shingles including durability, longevity of the roofing material, and decreased fire risk associated with lightning strikes.

In spite of the advantages, one common problem with metal roofs is water leakage. The leakage typically occurs at locations where individual sheets of the metal roof are joined together. Typically, the joints of metal roofs comprise fasteners which pass through holes in each one of a pair of overlapped sheets.

It is therefore desirable to provide a simple and unique solution for metal roofs which may overcome the problem of water leakage.

SUMMARY OF THE INVENTION

According to one aspect of the invention there is provided a fastener for coupling a pair of metal roof-covering sheets of a metal roofing system in an overlapping condition, each one of the roof-covering sheets having at least one aperture at or adjacent a longitudinal end edge of the respective roof-covering sheet that is overlapped, the fastener comprising:

- a shaft extending in a longitudinal direction for residing between the pair of the metal roof-covering sheets;
- at least one fastening peg at or adjacent one longitudinal end of the shaft that extends therefrom in a transverse direction so as to pass through the at least one aperture of one of the metal roof-covering sheets in the overlapping condition;
- at least one fastening feature carried on the shaft at a position longitudinally spaced from said at least one fastening peg for cooperation with the at least one aperture of the other one of the metal roof-covering sheets in a manner so as to longitudinally offset the apertures of the pair of metal roof-covering sheets in the overlapping condition.

In embodiments described in more detail hereinafter, misalignment of the apertures of the roof-covering sheets reduces likelihood of water or other fluid leaking through the roof-covering sheets. The likelihood of fluid leaking through the roof-covering sheets is further reduced when coupling apertures of an upper roof-covering sheet are located downstream (that is, in a direction from an upper end of the roof to a lower end thereof) of coupling apertures of a lower roof-covering sheet, so that any fluid which passes through the coupling apertures of the upper roof-covering sheet is thus resisted from migrating upstream towards the coupling apertures of the lower roof-covering sheet by the slope of the roof. Addition of sealant material between the upper and lower roof-covering sheets along covered end edges of the lower roof-covering sheets impedes upstream airflow between the roof-covering sheets that may push any fluid residing between the roof-covering sheets upstream.

In one embodiment, said at least one fastening feature comprises at least one opening passing through the shaft in the transverse direction for receiving at least one respective fastening member through said at least one opening and said at least one aperture of said another one of the metal-roof-covering sheets.

In another embodiment, said at least one fastening feature comprises at least one nailing spike extending from the shaft for driving of said spike into a roof deck through the at least one aperture of said another one of the roof-covering sheets in the overlapping condition.

The nailing spike preferably has a sharpened tip at a distal end thereof opposite the shaft.

In another embodiment, said at least one fastening feature comprises at least one additional peg extending from the shaft in an opposite transverse direction to the at least one fastening peg so as to pass through the at least one aperture of said another one of the roof-covering sheets in the overlapping condition.

In such instance, preferably the at least one fastening peg is located at or adjacent a first end of the shaft and the at least one additional peg comprises a pair of pegs that extend in a common second transverse direction from the shaft at or adjacent a second end of the shaft for engaging one of the pair of the roof-covering sheets so as to resist swiveling between the pair of the roof-covering sheets in the overlapping condition, the common second transverse direction of the pair of pegs being opposite to the transverse direction of the fastening peg.

Preferably the at least one additional peg is longer than the fastening peg.

Preferably the fastening peg and the additional peg both have a threaded tip receiving a respective threaded fastening element thereon so as to secure a respective one of the roof-covering sheets between the shaft and the respective fastening element.

The fastener is preferably used in combination with the pair of metal roof-covering sheets, which reside on a peaked roof having a peak at an upper end of the roof and a roof end edge at a lower end of the roof which is downstream of the upper end, the pair of metal roof-covering sheets being arranged in an overlapping condition in which an upper one of the roof-covering sheets partially overlaps a lower one of the roof-covering sheets, which is downstream of the upper roof-covering sheet, with the shaft of the fastener disposed between the pair of the roof-covering sheets, the fastening peg passing through one of the apertures the upper and lower roof-covering sheets, and the other of the upper and lower roof-covering sheets fastened to the at least one fastening feature through another one or more of the apertures in the other of the upper and lower roof-covering sheets to thereby couple the upper and lower roof-covering sheets together in a manner offsetting said one of the apertures from said another one or more of said apertures along a slope of the peaked roof so as to resist fluid leaks between the roof-covering sheets.

Preferably said one of the apertures through which the fastening peg passes through is located in the upper one of the roof-covering sheets.

In embodiments where the at least one fastening feature is at least one opening in the shaft receiving at least one respective fastening member, the at least one respective fastening member is preferably driven through another one or more of the apertures in the other one of the roof-covering sheets at the at least one opening in the shaft to thereby couple the upper and lower roof-covering sheets together in the offset manner.

In such instance, preferably the respective fastening member at each opening in the shaft is driven into a roof deck of the peaked roof driven through said another one or more apertures, which are preferably located in the lower one of the roof-covering sheets.

By providing an opening for receiving a fastening member, such as a nail, for example, whether in alternative or additionally to another fastening peg, this embodiment may provide easier mounting of the metal covering sheets to the roof deck in instances where a topside of the roof deck that is already covered by the covering sheets or underside of the roof deck may not be easily accessed.

Preferably said one of the apertures through which the fastening peg passes is in the upper roof-covering sheet, the aperture(s) cooperating with the fastening feature(s) are in the lower roof-covering sheet, and said one of the apertures in the upper roof-covering sheet is located downstream of said aperture(s) in the lower roof-covering sheet.

In embodiments in which the at least one fastening feature is at least one additional peg, and said another one or more apertures through which the at least one additional peg passes are found in the lower roof-covering sheet, the additional peg may pass through a roof deck of the pitched roof so as to secure the roof-covering sheets thereto.

Preferably sealant material is disposed between the pair of roof-covering sheets generally along the longitudinal end edges of the roof-covering sheet for impeding movement of fluid in a direction upstream of the roof-covering sheets.

Preferably the sealant material runs along a covered longitudinal edge of the lower roof-covering sheet at a position that is upstream of an exposed longitudinal edge of the upper roof-covering sheet and upstream of any aperture of the upper-roof covering sheet that resides adjacent said exposed longitudinal edge.

The roof-covering sheets may comprise an offset grid pattern simulating an appearance of asphalt shingles in an installed condition on the roof.

It will be appreciated that 'shaft' as used in this specification refers to a feature which extends in a longitudinal direction and is not limited by shape of its cross-section. As such, the shaft may be round or flat, for example. Also, for example, the shaft may be cylindrical or have cross-section of varying size along its longitudinal length.

It will also be appreciated that 'peg' as used in this specification does not denote a particular geometric shape such as a cylinder.

According to another aspect of the invention, there is provide a metal roof-covering sheet for covering a roof in an overlapping condition with another metal roof-covering sheet which has at least one aperture at or adjacent a longitudinal end edge thereof that is overlapped in said overlapping condition, the metal roof-covering sheet comprising:

a sheet body having opposing longitudinal end edges of which at least one is overlapped in the overlapping condition;

at least one aperture for receiving a respective fastening member therethrough to secure the sheet body during installation on the roof, said at least one aperture being located at or adjacent said one of the longitudinal end edges for overlapping;

at least one fastening peg extending transversely from the sheet body at a location spaced longitudinally of said at least one aperture for passing through the at least one aperture of the another metal roof-covering sheet so as to longitudinally offset the apertures of the sheet body and the another metal roof-covering sheet in the overlapping condition.

By locating the fastening pegs directly on the sheet body, the embodiment as described in more detail hereinafter may provide flush overlapping of the sheet bodies of the roof-covering sheets in the overlapping condition. Thus, the gaps between the roof-covering sheets in the overlapping may be reduced thereby affording other benefits including reduced use of sealant material for sealing the gaps and lower chances of water which has leaked through the apertures of the upper roof-covering sheet being pushed upstream by airflow.

Preferably the at least one fastening peg is located inward of said at least one aperture in a longitudinal direction of the sheet body so as to locate the at least one aperture of said another metal roof-covering sheet longitudinally inward of said at least one aperture of the sheet body.

Preferably the metal roof-covering sheet is used in combination with said another metal roof-covering sheet, wherein said metal roof-covering sheets reside on a peaked roof having a peak at an upper end of the roof and a roof end edge at a lower end of the roof which is downstream of the upper end, said metal roof-covering sheets being arranged in an overlapping condition in which an upper one of the metal roof-covering sheets partially overlaps a lower one of the metal roof-covering sheets which is downstream of the upper one of the metal roof-covering sheets, one of the upper and lower metal roof-covering sheets having the fastening peg thereof through a respective aperture of the other of the upper and lower metal roof-covering sheets in a manner offsetting said respective aperture of said other of the upper and lower roof-covering sheets from the at least one aperture of said one of the upper and lower roof-covering sheets along a slope of the peaked roof.

According to yet another aspect of the invention, there is provided a method of producing a metal roof-covering sheet for use in metal roofing for covering a roof, the metal roof-covering sheet having a peripheral edge delimiting an inner surface for facing inwardly toward the roof and an opposing outer surface, the method comprising:

providing the metal roof-covering sheet;

forming in the outer surface of said roof-covering sheet an offset grid pattern simulating an appearance of asphalt shingles in an installed condition on the roof.

According to another aspect of the invention, there is provided a fastener for coupling a pair of metal covering sheets of a metal roofing system in an overlapping condition, each one of the covering sheets having at least one aperture at or adjacent a longitudinal end edge of the respective covering sheet that is overlapped, the fastener comprising:

a shaft extending in a longitudinal direction for residing between the respective pair of the two or more covering sheets;

two or more fastening pegs respectively located at longitudinally spaced positions on the shaft, at least two of the fastening pegs extending from the shaft in opposite transverse directions so as to pass through the aperture of the respective covering sheet and longitudinally offset the apertures of the pair of covering sheets in the overlapping condition.

The fastening pegs may be respectively located at or adjacent first and second ends of the shaft. In one instance, the fastening pegs located at or adjacent one of the first and second ends of the shaft comprises a pair of fastening pegs that extend in a common transverse direction from the shaft for engaging one of the covering sheets so as to resist swiveling between the pair of the covering sheets in the overlapping condition.

According to another aspect of the invention there is provided a metal roofing system for a roof having a peak at an upper end of the roof and a roof end edge at a lower end of the roof which is downstream of the upper end, the metal roofing system comprising:

two or more metal covering sheets for covering the roof, each covering sheet comprising at least one aperture at or adjacent a longitudinal end edge of the covering sheet;

at least one pair of the covering sheets being arranged in an overlapping condition in which an upper one of the covering sheets partially overlaps a lower one of the covering sheets which is downstream of the upper covering sheet;

one or more fasteners coupling said at least one pair of the covering sheets in the overlapping condition, each fastener comprising:

a shaft extending in a longitudinal direction that is disposed between the pair of the covering sheets;

two or more fastening pegs respectively located at longitudinally spaced positions on the shaft, at least two of the fastening pegs extending from the shaft in opposite transverse directions so as to pass through the apertures of the upper and lower ones of the covering sheets in a manner offsetting said at least one aperture of one of the upper and lower covering sheets in a direction downstream of said at least one aperture of another one of the upper and lower covering sheets for resisting fluid leaks between the covering sheets.

Preferably, the at least one aperture of the upper covering sheets is located downstream of the at least one aperture of the lower covering sheet.

At least one of the fastening pegs of at least one of the fasteners may include threaded tips receiving a threaded fastening element thereon so as to secure the respective one of the upper and lower covering sheets along its thickness between the shaft of the fastener and the fastening element.

In one instance, one of the upper and lower coverings sheets comprises two apertures. The fastening pegs are respectively located at or adjacent first and second ends of the shaft. The fastening pegs located at or adjacent one of the first and second ends of the shaft may comprise a pair of fastening pegs that extend in a common transverse direction from the shaft for engaging one of the pair of the covering sheets so as to resist swiveling between the pair of the covering sheets in the overlapping condition.

In one instance, the fastening pegs which pass through the aperture of the lower covering sheet have sufficient length for passing through a roof deck of the roof so as to secure the covering sheets thereto. The roof deck may also be referred to as the support or base frame of the roof.

Preferably, sealant material is disposed between the pair of covering sheets generally along a covered longitudinal edge of the lower roof-covering sheet for impeding movement of fluid in a direction upstream of the covering sheets.

The covering sheets may comprise an offset grid pattern simulating an appearance of asphalt shingles in an installed condition on the roof.

According to yet a further aspect of the invention, there is provided a metal roofing system for a roof having a peak at an upper end of the roof and a roof end edge at a lower end of the roof which is downstream of the upper end, the metal roofing system comprising:

two or more metal covering sheets for covering the roof, each covering sheet comprising a sheet body and at least one aperture at or adjacent a longitudinal end edge of the sheet body;

at least one pair of the covering sheets being arranged in an overlapping condition in which an upper one of the covering sheets partially overlaps a lower one of the covering sheets which is downstream of the upper covering sheet;

one of the upper and lower covering sheets including at least one fastening peg extending transversely from the sheet body at a location spaced longitudinally of said at least one aperture of the respective one of the upper and lower covering sheets so as to pass through the at least one aperture of another one of the upper and lower covering sheets in a manner offsetting said at least one aperture of one of the upper and lower covering sheets in a direction downstream of said at least one aperture of another one of the upper and lower covering sheets for resisting fluid leaks between the covering sheets.

Preferably, the at least one fastening peg of said one of the upper and lower covering sheets is located inward of said at least one aperture thereof in a longitudinal direction of the sheet body so as to be spaced away from said at least one aperture and from the longitudinal edge.

Preferably, said one of the upper and lower covering sheets having the at least one fastening peg comprises the lower covering sheet. Thus, locating the at least one fastening peg longitudinally inward of the at least one aperture of the lower covering sheet locates the at least one aperture of the upper covering sheet downstream relative thereto.

At least one of the fastening pegs may include a threaded tip receiving a threaded fastening element thereon so as to secure said another one of the upper and lower covering sheets along its thickness between the sheet body and the fastening element.

Except where explicitly defined as mutually exclusive, all or any of the above features may be combined.

According to another aspect of the invention, there is provided, in combination, a pair of upper and lower metal roof-covering sheets residing atop a sloped roof; and a fastener, a fastening element and at least one fastening member that cooperatively couple said pair of metal roof-covering sheets to one another and to the sloped roof; wherein a lower end of the roof resides downstream of an upper end of the roof, the pair of upper and lower metal roof-covering sheets are arranged in an overlapping condition in which the upper metal roof-covering sheet partially overlaps the lower metal roof-covering sheet in upstream relation thereto such that a downstream edge of the upper metal roof-covering sheet overlies the lower metal roof-covering sheet near an upstream edge thereof, the upper metal roof-covering sheet has a first aperture therein at a location adjacent the downstream edge thereof, the fastener lies atop the lower metal roof-covering sheet beneath the upper metal roof-covering sheet and is coupled to the upper metal roof-covering sheet by mating together of the fastener and the fastener element through the first aperture in said upper metal roof covering sheet, the fastener has at least one opening therein which overlies at least one additional aperture in the lower metal roof-covering sheet at an area thereof that resides upstream of the first aperture in the upper metal roof-covering sheet, and the at least one fastening member is driven into the sloped roof through both the at least one additional aperture in the lower metal roof-covering sheet, and the at least one opening in the fastener.

BRIEF DESCRIPTION OF THE DRAWINGS

Preferred embodiments of the invention will now be described in conjunction with the accompanying drawings in which.

In the drawings like characters of reference indicate corresponding parts in the different figures.

DETAILED DESCRIPTION

Figure 1:
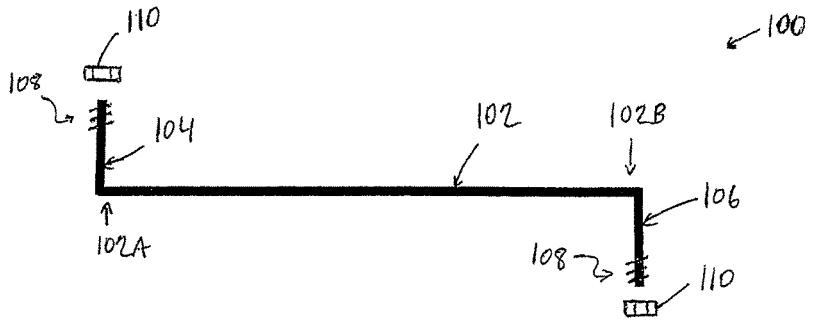
FIG. 1 is a side view of a first embodiment of a fastener according to the present invention.

Referring to FIGS. 1-6, there is illustrated a fastener suited for use in metal roofing. Preferred embodiments of the fastener are illustrated and generally indicated by reference numerals 100 and 100' respectively. The fastener 100 or 100' may be sold as a kit or metal roofing system which includes metal roof-covering sheets 101 or tiles for covering a roof 1 of a building. Alternatively, the fastener may be sold separately—that is, individually of other components of the metal roofing system.

Generally speaking, the roof has a peak at an upper end of the roof and a roof end edge at a lower end of the roof which is downstream of the peak or upper end of the roof. Especially in residential applications, the roof is sloped downwardly from the peak to the roof end edge. Note that the downstream direction and an opposing upstream direction are respectively indicated at 'D' and 'U'.

The fastener 100 or 100' comprises a shaft 102 extending in a longitudinal direction of the fastener. The fastener includes a plurality of fastening pegs 104 and 106 respectively located at longitudinally spaced position on the shaft 102. Regardless of the specific number of fastening pegs, at least two of the fastening pegs extend from the shaft in opposite transverse directions. Typically, the fastenings pegs are respectively located at or adjacent first and second ends 102A and 102B of the shaft so as to be closer to one end than the other. Consequently, the fastener overall is zig-zag shaped in transverse side view.

Figure 2:
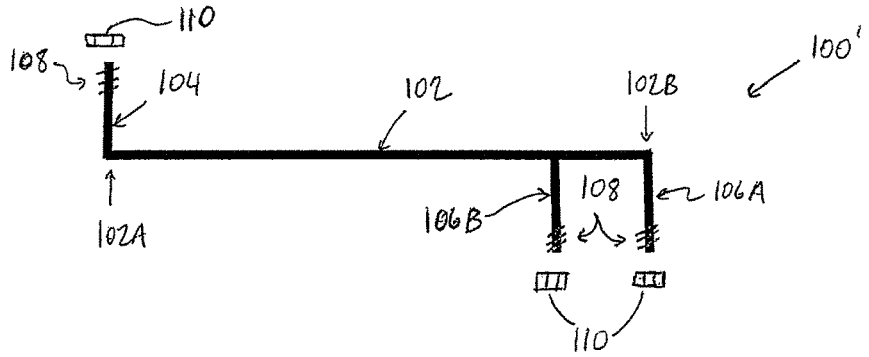
FIG. 2 is a side view of a second embodiment of the fastener according to the present invention.

Furthermore, in the illustrated embodiment, each fastening peg has a threaded tip 108 as schematically shown in FIGS. 1 and 2 onto which a threaded fastening element 110 such as a nut is received.

In the first embodiment, the fastener 100 has two fastening pegs 104 and 106. One fastening peg is located at each of the first and second ends 102A, 102B of the shaft.

In the second embodiment, the fastener 100' has three fastening pegs 104, 106A, and 106B. Two of these (those being 106A, 106B) are located at or adjacent the second end 102B of the shaft and which extend in a common one of the transverse directions from the shaft 102. The reason for having a pair of the fastening pegs will become apparent later.

In one arrangement (irrespective of either one of the two illustrated embodiments), the fastening pegs may be sufficiently long so that the fastening pegs can pass through a roof deck 4 or support frame of the roof 1. Thus, the fastener 100 or 100' and the roof-covering sheets 101 which the respective fastener couples together may be secured to the roof deck 4.

Figure 3:
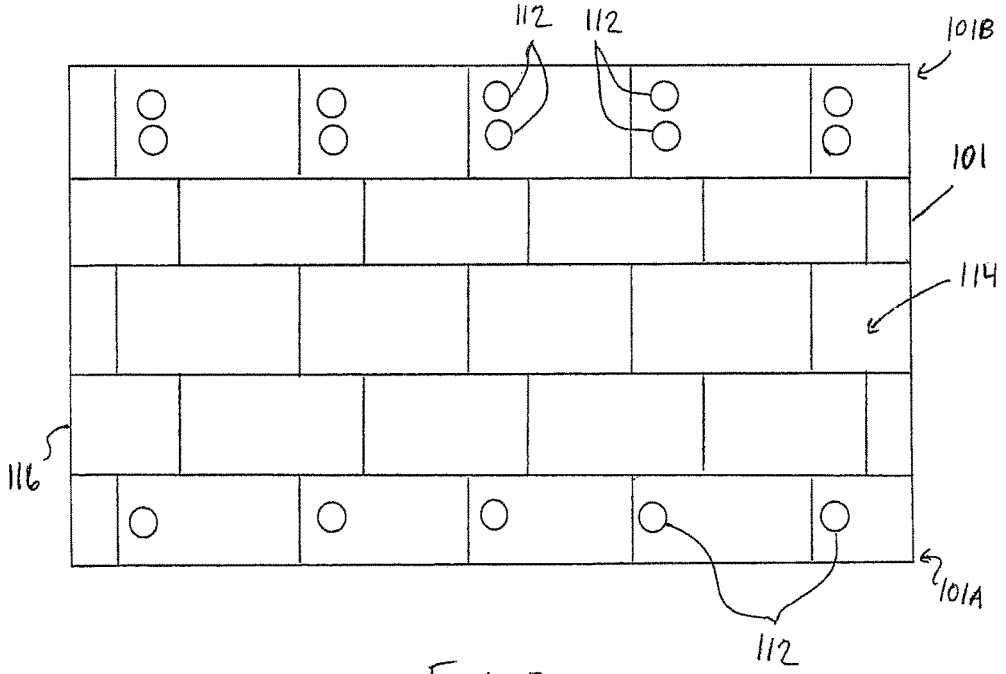
FIG. 3 is a plan view of a metal roof-covering sheet or tile for metal roofing according to the present invention.

Turning our attention to the roof-covering sheets, in the illustrated embodiment each roof-covering sheet 101 is rectangular in shape. However, in other embodiments, the roof-covering sheets may be of different shapes and also of different sizes (between applications) so long as the roof-covering sheets may be positioned in a manner so as to fully cover the roof. Each roof-covering sheet comprises at least one row of apertures 112 along each longitudinal end edge 101A, 101B of the respective roof-covering sheet. In one arrangement of the roof-covering sheet (not shown), the roof-covering sheet has one row of apertures along each longitudinal end edge so as to be suited for cooperation with the fastener 100 of the first embodiment as in FIG. 1. In another arrangement as shown in FIG. 3, the roof-covering sheet has two rows of apertures 112 along one of the longitudinal end edges 101B and one row of apertures along another one of the longitudinal end edges 101A so as to be suited for cooperation with the fastener 100' of the second embodiment as in FIG. 2. The apertures should be spaced from one another at a predetermined distance in a longitudinal direction so as to make installation of the roof-covering sheets easier. Since the shape and size of the roof-covering sheets may vary, the apertures may be spaced at a selected distance from a respective longitudinal end of the roof-covering sheet of the particular arrangement so as to have a predictable and similar fit from one arrangement to another.

Figure 4:
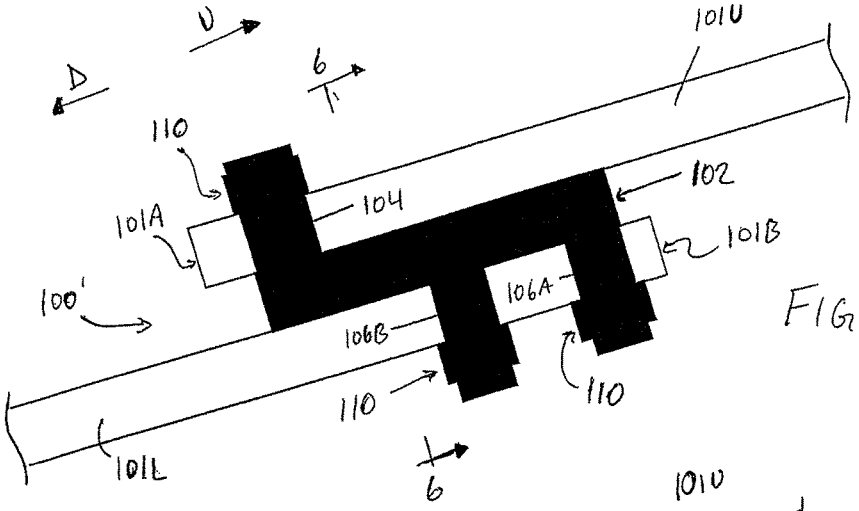
FIG. 4 is a schematic view of a first arrangement of the fastener of FIG. 2 coupling a pair of roof-covering sheets in an overlapping condition.
Figure 5:
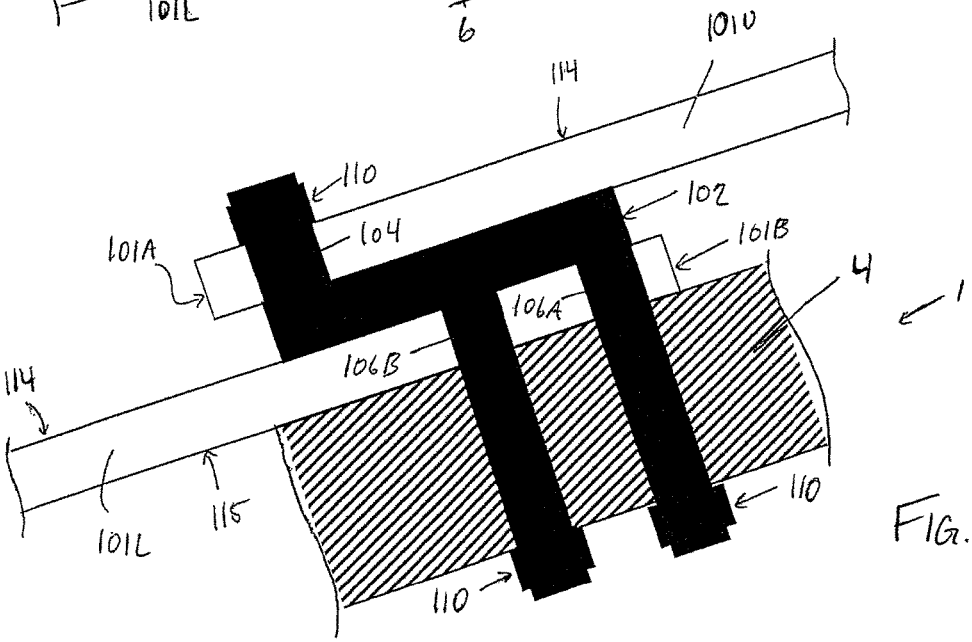
FIG. 5 is a schematic view of a second arrangement of the fastener of FIG. 2 coupling the pair of roof-covering sheets in the overlapping condition.
Figure 6:
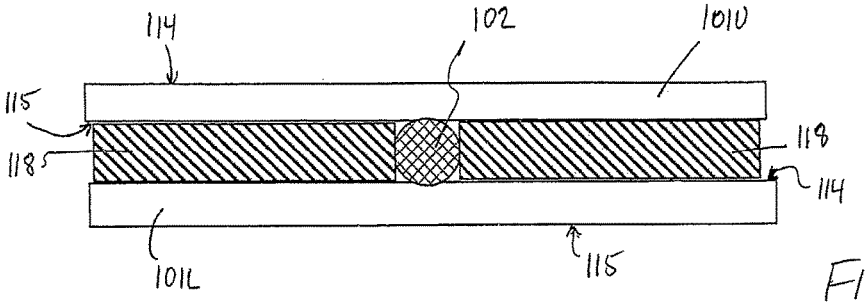
FIG. 6 is a cross-sectional view along line 6-6 in FIG. 4.

With the above structure of the roof-covering sheets in mind, the roof-covering sheets 101 are arranged to be coupled in an overlapping condition better shown in FIGS. 4-6 in which one of the longitudinal end edges 102A of an upper roof-covering sheet 101U is located beyond one of the longitudinal end edges 102B of a lower roof-covering sheet 101L so as to be disposed over a main portion of the lower roof-covering sheet. As such, the set or group of fastening pegs 104, 106 at or adjacent each of the first and second shaft ends 102A, 102B pass through one of the apertures 112 at the respective longitudinal end edge of one of the upper and lower roof-covering sheets. The shaft 102 of the respective fastener 100 or 100' thus is disposed or resides between the upper and lower roof-covering sheets 101U, 101L. Note that in the second embodiment 100' in which the pair of fastening pegs 106A and 106B is located at the second end of the shaft, the pair of fastening pegs engages the same roof-covering sheet so as to resist swiveling between the pair of the roof-covering sheets in the overlapping condition. It will be appreciated that a roofing system in which each roof-covering sheet has more than one row of apertures along only one of the longitudinal end edges of the respective sheet is sufficient for resisting swiveling between each pair of roof-covering sheets.

As known in the art, the roof-covering sheets 101 are typically corrugated so as to have ridges running longitudinally of the roof-covering sheets which form protrusions on an outer surface 114 of the respective roof-covering sheet and recessed grooves on an inner surface 115 of the respective roof-covering sheet which faces the roof deck. Thus, roof-covering sheets disposed side-by-side, that is transverse to the upstream or downstream directions of the roof U or D, can be overlapped in the side-by-side direction to reduce relative side-to-side movement between each pair of side-by-side roof-covering sheets.

In the illustrated embodiment, the outer surface 114 of the roof-covering sheet, which is delimited by a peripheral edge 116 thereof, comprises an offset grid pattern simulating an appearance of asphalt shingles in an installed condition on the roof. In the illustrated embodiment, the grid pattern is formed by stamping the roof-covering sheet 101 with the offset grid pattern using a machine such as a stamping press. Thus, the roof-covering sheets may appear like asphalt shingles from afar, which may be desirable given the popularity of asphalt shingles especially in residential roofing applications.

In use, the roof-covering sheets 101 are typically installed starting at or adjacent the lower end of the roof. Then, successive roof-covering sheets are installed in a direction upstream, that is, towards the upper end or peak of the roof. Within each pair of roof-covering sheets, the fastening pegs 106 or 106A, 106B of the respective fastener at the second end 102B thereof are inserted through the apertures 112 of the lower roof-covering sheet 101L. The apertures 112 of the lower roof-covering sheet, which will be used for coupling to the upper roof-covering sheet 101U, are oriented at an upstream end of the lower roof-covering sheet. The fastener is oriented such that the fastening peg 104 extending upwardly in a position ready to receive the upper roof-covering sheet 101U is located downstream D of the fastening pegs 106 or 106A, 106B inserted into the lower roof-covering sheet 101L. Note that the fastening pegs passing through the lower roof-covering sheet may also be inserted through the roof deck 4 if this arrangement is chosen. The fastening elements 110 are then inserted onto the tips 108 of the fastening pegs at the second end of the shaft so as to secure the lower roof-covering sheet 101L along its thickness between the shaft 102 of the respective fastener and the fastening element 110. When the fastening pegs are inserted through the roof deck 4 as shown in FIG. 5, the roof deck 4 is also disposed along its transverse thickness between the shaft 102 and the fastening element 110 but below the lower roof-covering sheet 101L when viewed in a direction transverse to the roof deck.

The upper roof-covering sheet 101U is disposed, in the overlapping condition, onto the lower roof-covering sheet 101L as viewed in the direction transverse to the roof deck. Within the respective pair of the roof-covering sheets, the apertures 112 of the upper roof-covering sheet through which the fastening peg 104 at the first end 102A of the shaft passes are consequently located downstream D of the apertures of the lower roof-covering sheet 101L through which the fastening pegs 106 or 106A, 106B at the second end 102B of the shaft pass. Similarly to a process of fastening of the lower roof-covering sheet, the upper roof-covering sheet 101U is disposed along its thickness at a location on the respective fastening peg 104 at the first end of the shaft between the shaft 102 and the fastening element 110 received on the tip 108 so as to be secured between the shaft and fastening element. This process of partially overlaying or overlapping roof-covering sheets in the direction upstream and fastening each pair of roof-covering sheets disposed in the overlapping condition in the upstream direction continues until the roof between the lower and upper ends thereof is covered.

During installation of the roof-covering sheets in the overlapped condition coupled to one another by the fastener 100 or 100', a sealant material 118 such as sealing tape is laid along an upstream or upper longitudinal edge 101B of the lower roof-covering sheet that is subsequently covered by the respective upper roof-covering sheet. The sealant runs parallel to the longitudinal edges of the roof-covering sheets, but is applied suitably close to the upstream longitudinal edge 101B of the lower roof-covering sheet so as to be spaced upstream from both the exposed or free longitudinal edge 101A of the upper roof-covering sheet 101A and the downstream set of apertures in the upper roof-covering sheet that lie adjacent this exposed longitudinal edge 101A. The sealant material fills an entirety of the gap that is created between the roof-covering sheets 101 by the presence of the fastener's shaft 102 between them. The spacing of the sealant material upstream from the free longitudinal end edge 101*a* at or near the covered longitudinal edge 101B of the lower roof-covering sheet may be such that the sealant is transversely inline with the shaft 102. In this instance, the sealant material 118 may be discontinued at each fastener 100 or 100' so as to be disposed only in areas of the gap that resides between adjacent fasteners, as shown in FIG. 6 where the shaft 102 of a fastener can be seen in the break between two discretely adjacent spans of the sealant material. With the sealant located only upstream of the downstream apertures in the upper roof-covering sheet of each pair, any water or other liquid passing downwardly through the downstream apertures of the upper roof-covering sheet can continue flowing downstream on the lower roof-covering sheet without interference by the sealant. The coverage of the lower roof-covering sheet by the sealant material preferably includes an area downstream of the apertures defined in the lower-roof covering sheet adjacent the covered longitudinal edge 101B thereof.

Thus, the overall metal roofing system described herein seeks to overcome the potential problem of leakage in traditional metal roofs. The fasteners 100 or 100' are shaped so that the apertures 112 of overlapping roof-covering sheets 101U, 101L are offset or misaligned. More specifically, the fasteners 100 or 100' are oriented in an installed condition as better shown in FIGS. 4 and 5 so that the apertures 112 of the upper roof-covering sheet 101U are located downstream D of the apertures 112 of the lower roof-covering sheet 101L. Thus, any water or liquid which is able to pass through the apertures 112 of the upper roof-covering sheet 101U is unlikely to bypass the lower covering 101L sheet because the apertures 112 thereof are located upstream U of the apertures in the upper roof-covering sheet through which the water first passed. The traditional sloping of the roof, which is downward from the peak to the roof end edge, resists migration of the water (by gravity) upwardly towards the apertures 112 of the lower roof-covering sheet 101L. Additionally and furthermore, the sealant material 118 disposed transversely along the covered longitudinal edge 101B of the lower roof-covering sheet 101L in a location between the overlapped roof-covering sheets impedes or obstructs airflow in an upstream direction U which may push the water which has leaked through the upper roof-covering sheet 101U upstream toward the apertures 112 in the lower roof-covering sheet 101L. Moreover, the sealant material 118 may obstruct other debris or water or liquid which has not leaked through the upper roof-covering sheet from entering between the overlapped roof-covering sheets and later leaking through the apertures of the lower roof-covering sheet or simply accumulating between the overlapped roof-covering sheets.

In another arrangement of the fastener 100 or 100', the fastening pegs 106, 106A, or 106B that are adjacent the second end 102B of the shaft and which pass through the lower roof-covering sheet 101L may comprise tapered ends such that the fastening pegs are arranged to be driven into a roof deck 4. The tapered fastening pegs may be driven with a tool such as with a hammer, for example. This arrangement is suited for an existing roof in which an underside of the roof deck 4 may not be readily accessed from a topside of the roof thus inhibiting installation of threaded fastening elements 110 such as nuts on ends of the fastening pegs which are at the second end 102B.

Figure 7:
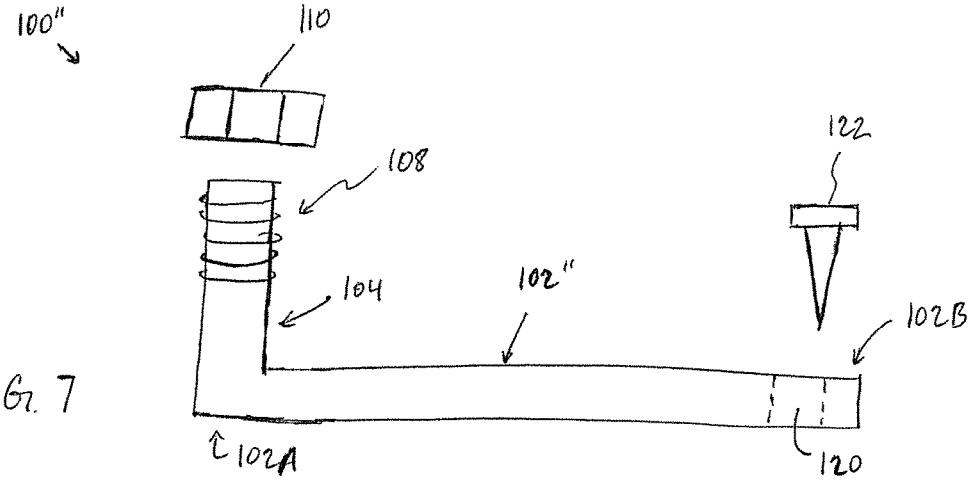
FIG. 7 is a side view of a third embodiment of a fastener according to the present invention.
Figure 8:
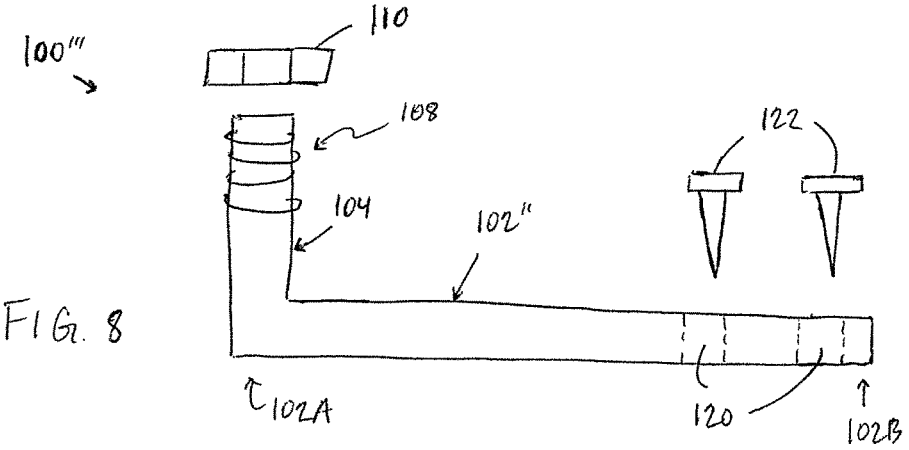
FIG. 8 is a side view of a fourth embodiment of the fastener according to the present invention.
Figure 9:
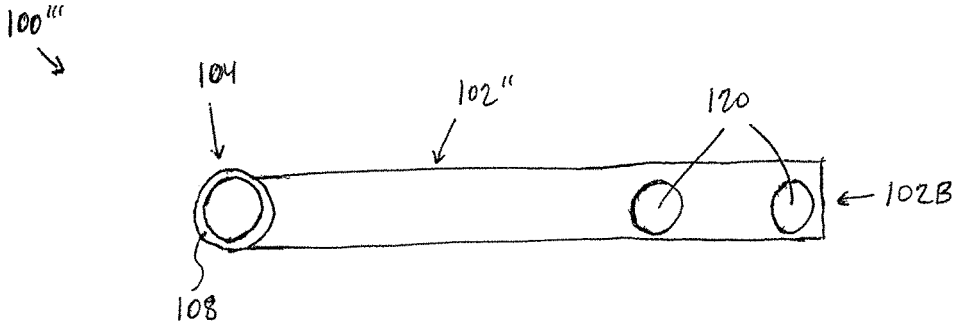
FIG. 9 is a plan view of the fastener of FIG. 8.
Figure 10:
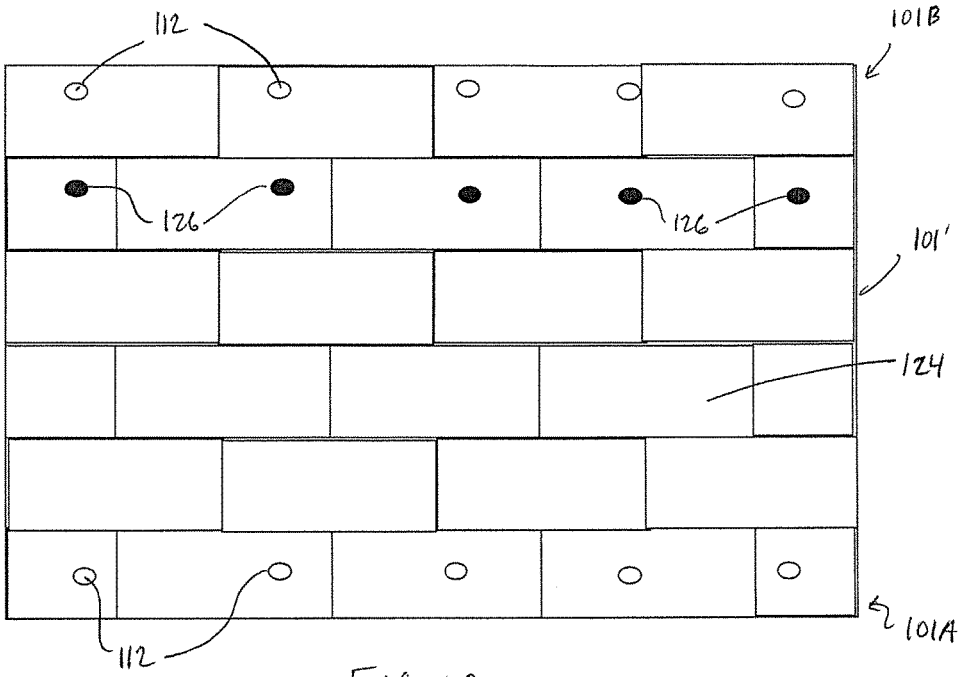
FIG. 10 is a plan view of another embodiment of a metal roof-covering sheet or tile according to the present invention.

Further embodiments of the fastener are illustrated in FIGS. 7-9 and generally indicated by reference numerals 100" and 100'". The fastener comprises a longitudinally elongate shaft 102" similar to that of the illustrated embodiments shown in FIGS. 1-6. The fastener 100" or 100'" also includes a fastening peg 104 at a first end 102A of the shaft 102" similar to that of the previous embodiments as shown in FIGS. 1-6. In contrast to the previously shown embodiments, the shaft 102" carries or supports at least one opening 120 adjacent a second end 102B" thereof in place of the fastening pegs 106 or 106A, 106B. The opening 120 extends through the shaft 102" in a transverse direction along that of the fastening peg 104 such that a fastening member 122 may be driven through the opening 120 in a transverse direction opposite to that in which the fastening peg 104 extends from the shaft 102". For example, the fastening member 122 comprises a nail. In use of the fastener 100" or 100'", the fastening member 122 passes though the opening 120 and one of the apertures 112 of the roof-covering sheet with which the opening 120 is aligned. Typically, the fastening member is driven through one of the apertures of the lower roof-covering sheet 101L that are positioned at the upstream end thereof. As such, the fastening member 122 is suited for mounting the lower roof-covering sheet to the roof deck 4 and for securing the fastener 100" or 100'" in fixed position relative to the lower roof-covering sheet 101L. Once the fastening member 122 is holding the fastener 100" or 100'" in fixed relation to the lower roof-covering sheet 101L, the upper roof-covering sheet 101U may be received over the fastening peg 104 that is oriented downstream D of the opening 120. Note that the fastener 100" or 100'" may comprise one opening as shown in FIG. 9 or two openings as illustrated in FIG. 10 for resisting swiveling of one roof-covering sheet relative to another one of roof-covering sheets in the coupled overlapping position, similar to the motivation behind the embodiment of the fastener 100' that is more clearly shown in FIG. 2. Furthermore, this arrangement is suited for an existing roof in which an underside of the roof deck 4 may not be easily accessed from a topside of the roof thus inhibiting installation of threaded fastening elements 110 such as nuts on ends of the fastening pegs which are at the second end 102B, as shown in FIG. 5. Also, providing fastening members 122 separate of fastener 100" or 100'" may lessen damage to the fastener and lower roof-covering sheet 101L during an action of driving the fastening members 122 through the openings 120 of the fastener and the apertures 112 of the lower roof-covering sheet 101L.

Figure 13:
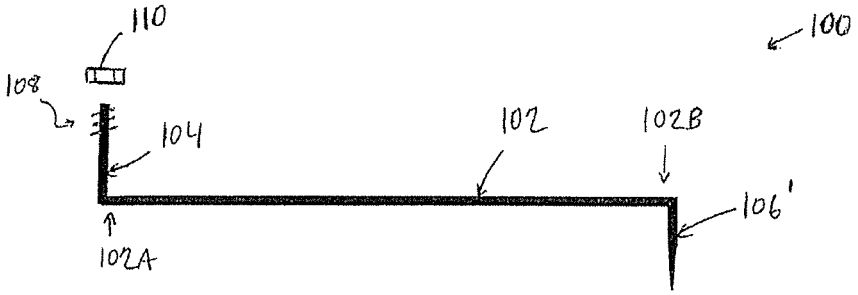
FIG. 13 is a side view of another embodiment of the fastener of the present invention.

Thus, the openings 120 in the shaft 102" and the fastening pegs 104 and 106 or 106A, 106B all define fastening features of the various forgoing embodiments of the fastener for cooperation with the apertures 112 in the roof-covering sheets. FIG. 13 shows another embodiment of the fastener in which the fastening feature is a sharpened nailing spike 106' that replaces one of the threaded fastening pegs 106 of the FIG. 1 embodiment. The nailing spike 106' is used just like the nail 122 of the FIG. 7, driven down through the aperture in the lower roof-covering sheet into the roof deck. The fastener may alternatively have two nailing spikes in place of the two fastenings pegs at one end of the FIG. 2 embodiment.

Figure 11:
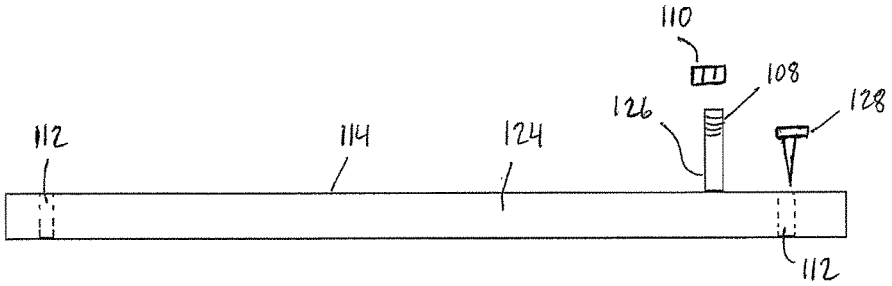
FIG. 11 is a side view of the metal roof-covering sheet of FIG. 10.
Figure 12:
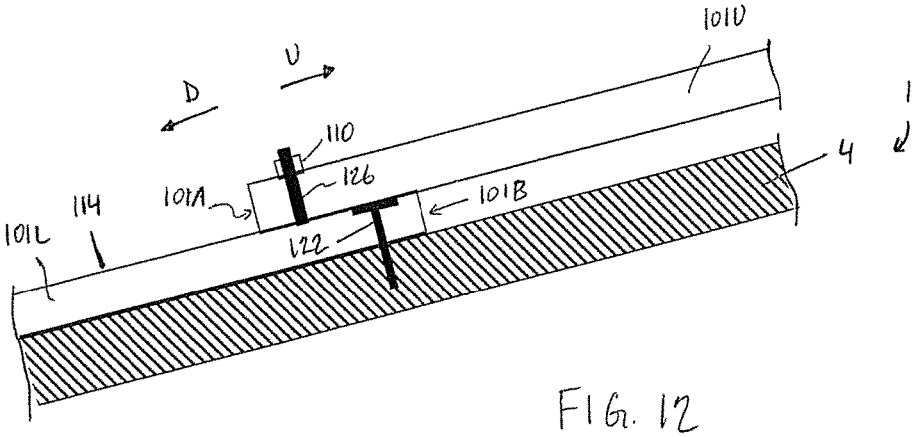
FIG. 12 is a schematic view of the metal roof-covering sheet of FIG. 10 coupled to another roof-covering sheet in an overlapping condition.

Referring to FIGS. 10-12, there is illustrated a fastening arrangement for metal roofs comprising a metal roof-covering sheet indicated at 101'. The roof-covering sheet 101' has a sheet body 124 similar to that of the roof-covering sheet 101 that is more clearly shown in FIG. 3. That is, the roof-covering sheet comprises one row of apertures 112 along each longitudinal end edge 101A, 101B of the roof-covering sheet. In addition to the row of apertures along the end edge 101B that is oriented at the upstream end of the roof-covering sheet on the roof 1, the roof-covering sheet 101' comprises a row of fixed fastening pegs 126 each of which is similar to the fastening pegs 104, 106, and 106A, 106B. Each fixed fastening peg 126 extends transversely from the sheet body 124 so as to protrude therefrom. Relative to a longitudinal direction of the sheet body 126, the fixed fastening pegs are located inwardly of the row of apertures 112 along the longitudinal end edge 101B which, in the overlapping condition, is disposed underneath the other one of the pair of coverings sheets. As such, the fixed fastening pegs are longitudinally spaced from the apertures. Furthermore, the row of fastening pegs are spaced farther from the longitudinal end edge 101B than the row of apertures 112 is spaced therefrom. Moreover, the fixed fastening pegs 126 are located downstream of the apertures 112 that are positioned at the upstream end. Thus, the row of fastening pegs 126 locate the apertures 112 of the upper roof-covering sheet 101U in a position downstream D of the apertures 112 of the lower roof-covering sheet 101L that are overlapped by the upper roof-covering sheet in the overlapping condition for the reasons described hereinbefore. Each fastening peg 126 has a threaded tip 108" like the fastening pegs of the formerly shown embodiments so as to threadably receive a fastening element 110 thereon for fastening the upper roof-covering sheet along its thickness to the lower roof-covering sheet between the sheet body of the lower roof-covering sheet and the fastening element 110. Furthermore, the apertures 112 which are overlapped receive fastening members 128 such as nails or screws, for example, to secure the lower roof-covering sheet 101L to the roof deck 4. The fastening members 128 may be received in the respective aperture so as to be flush with the outer surface 114 of the sheet body 124 as shown in FIG. 12. As such, in this arrangement, the upper and lower roof-covering sheets may lie substantially flush against one another such that there are small or no gaps therebetween. Consequently, likelihood of airflow pushing water which has leaked through the apertures 112 of the upper roof-covering sheet 101U may be reduced and use of sealant material may be reduced if it is needed at all.

Since various modifications can be made in my invention as herein above described, and many apparently widely different embodiments of same made, it is intended that all matter contained in the accompanying specification shall be interpreted as illustrative only and not in a limiting sense.

The invention claimed is:

1. In combination, a pair of upper and lower metal roof-covering sheets (101U, 101L) residing atop a sloped roof (1); and a fastener (100"), a fastening element (110) and at least one fastening member (122) that cooperatively couple said pair of metal roof-covering sheets (101U, 101L) to one another and to the sloped roof; wherein a lower end of the roof resides downstream of an upper end of the roof, the pair of upper and lower metal roof-covering sheets are arranged in an overlapping condition in which the upper metal roof-covering sheet (101U) partially overlaps the lower metal roof-covering sheet (101L) in upstream relation thereto such that a downstream edge (101A) of the upper metal roof-covering sheet (101U) overlies the lower metal roof-covering sheet (101L) near an upstream edge (101B) thereof, the upper metal roof-covering sheet (101U) has a first aperture therein at a location adjacent the downstream edge (101A) thereof, the fastener (100") lies atop the lower metal roof-covering sheet (101L) beneath the upper metal roof-covering sheet (101U) and is coupled to the upper metal roof-covering sheet (101U) by mating together of the fastener (100") and the fastener element (110) through the first aperture in said upper metal roof covering sheet (101U), the fastener (100") has at least one opening (120) therein which overlies at least one additional aperture in the lower metal roof-covering sheet (101L) at an area thereof that resides upstream of the first aperture in the upper metal roof-covering sheet (101U), and the at least one fastening member (122) is driven into the sloped roof (1) through said at least one opening (120) in the fastener (100") and said at least one additional aperture in the lower metal roof-covering sheet (101L).

2. The combination of claim 1 wherein the at least one fastening member (122) is driven into a roof deck (4) of the sloped roof (1) through said at least one opening (120) in the fastener and said at least one additional aperture in the lower metal roof-covering sheet (101L).

3. The combination of claim 1 wherein the at least one fastening member (122) comprises at least one nail.

4. The combination of claim 1 wherein the at least one opening (120) in the fastener comprises two openings, and the at least one fastening member (122) comprises two fastening members respectively driven through the two openings of the fastener.

5. The combination of claim 4 wherein each fastening member (122) is a nail.

6. The combination of claim 1 wherein the fastener and the fastening element are cooperatively threaded.

* * * * *